US007238068B2

(12) United States Patent
Nagashima et al.

(10) Patent No.: US 7,238,068 B2
(45) Date of Patent: Jul. 3, 2007

(54) BOAT AND OUTBOARD MOTOR HAVING AIR INTAKE SYSTEM

(75) Inventors: Mitsuru Nagashima, Shizuoka-ken (JP); Yu Ito, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 11/273,041

(22) Filed: Nov. 14, 2005

(65) Prior Publication Data

US 2006/0105648 A1 May 18, 2006

(30) Foreign Application Priority Data

Nov. 18, 2004 (JP) ..... 2004-335025

(51) Int. Cl.
*B63H 20/32* (2006.01)

(52) U.S. Cl. ..... 440/77; 440/88 A

(58) Field of Classification Search ..... 440/76, 440/77, 88 A, 88 R
See application file for complete search history.

(56) References Cited

U.S. PATENT DOCUMENTS

| | | | | |
|---|---|---|---|---|
| 4,952,180 | A * | 8/1990 | Watanabe et al. | 440/77 |
| 5,277,633 | A | 1/1994 | Kato et al. | |
| 5,937,818 | A * | 8/1999 | Kawai et al. | 440/77 |
| 6,413,131 | B1 * | 7/2002 | Phillips et al. | 440/88 R |
| 6,899,579 | B1 * | 5/2005 | Bruestle | 440/88 A |

* cited by examiner

*Primary Examiner*—Lars A. Olson
(74) *Attorney, Agent, or Firm*—Knobbe, Martens, Olson & Bear, LLP.

(57) ABSTRACT

A boat includes an outboard motor having an internal combustion engine enclosed within a cowling. The cowling has a rear inlet port for allowing outside air to be drawn into the cowling. A closure member selectively closes the inlet port depending upon a certain engine operating parameters. In another embodiment, the cowling also includes a front air inlet port, and a front closure device for selectively opening and closing the front inlet port.

23 Claims, 4 Drawing Sheets

BOAT AND OUTBOARD MOTOR HAVING AIR INTAKE SYSTEM

CROSS-REFERENCE TO RELATED APPLICATIONS

This application claims priority to Japanese Patent Application No. JP 2004-335025, which was filed on Nov. 18, 2004, the entirety of which is hereby incorporated by reference.

BACKGROUND OF THE INVENTION

1. Field of the Invention

The present invention is in the field of powered boats and outboard motors. More specifically, the present invention relates to an air intake system for an outboard motor.

2. Description of the Related Art

Small power boats often include one or more outboard motors to provide propulsion for the boat. The outboard motor includes an internal combustion engine enclosed within a cowling. An air inlet port is formed through the cowling and provides air to the internal combustion engine. Preferably, the air inlet port includes a structure for preventing water, waves, splashes, or the like from intruding into the cowling. Commonly, air inlet ports are formed through a rear portion of the cowling in order to better avoid intrusion of water splashes, spray and the like through the inlet port while the boat is being driven forwardly.

Positioning of the inlet port in the rear portion of the outboard motor is not advantageous in all situations. For example, when the boat is proceeding in reverse, the rear inlet port is especially exposed to water splashing. Similarly, upon sudden deceleration, the rear inlet port is exposed to water splashes.

SUMMARY OF THE INVENTION

Accordingly, there is a need in the art for an outboard motor air intake system that optimizes an air intake port configuration based upon boating conditions in order to more efficiently and effectively minimize entry of water through the cowling while simultaneously ensuring sufficient supply of air to the engine.

In accordance with one embodiment, an outboard motor is provided. The outboard motor comprises an internal combustion engine and a cowling. The cowling generally encloses at least an upper portion of the engine and defines an engine compartment. The cowling has front and rear portions. A rear air inlet port is formed through the rear portion of the cowling. The rear inlet port has a rear closure device adapted to selectively move between an open position and a closed position so that when the closure device is in the open position air from outside the cowling can be selectively drawn through the rear inlet port, and when the closure device is in the closed position air does not substantially pass through the rear inlet port.

In accordance with another embodiment, the outboard motor additionally comprises a front air inlet port formed through the front portion of the cowling. The front inlet port has a front closure device adapted to selectively move between an open position and a closed position. The front closure device is adapted so that when the closure device is in the open position air from outside the cowling can be selectively drawn through the front inlet port, and when the closure device is in the closed position air does not substantially pass through the front inlet port.

In accordance with still another embodiment, the rear closure device comprises a plurality of flaps, each flap being pivotably mounted to edges of the port. The flaps are arranged generally adjacent one another and are adapted to pivot so as to generally engage one another to close the inlet when in the closed position.

In accordance with still further embodiments, an actuator is adapted to move the rear closure device between the open and closed positions. Additionally, a controller is adapted to control operation of the actuator based upon certain sensed conditions. For example, in one embodiment the controller is adapted to close the rear air inlet port and open the front inlet port when a transmission of the outboard motor changes to the reverse drive state. In another embodiment, the controller is adapted to close the front air inlet port and open the rear inlet port when the transmission changes to the forward drive state. In a further embodiment, the controller is adapted to open the front air inlet port when the transmission is in the forward drive state and an engine speed sensor indicates that engine speed is above a threshold level.

In accordance with a still further embodiment, the present invention provides an outboard motor comprising an internal combustion engine and a cowling. The cowling generally encloses at least a portion of the engine and has a front portion and a rear portion. A rear inlet port is formed in the rear portion, the rear inlet port comprising means for selectively closing the rear port. A front inlet port is formed in the front portion, the front inlet port comprising means for selectively closing the front port.

In accordance with still another embodiment, the outboard motor additionally comprises means for determining when to open and/or close the front and rear ports. In further embodiments, the determining means comprises means for monitoring engine conditions, means for analyzing monitored engine conditions, and means for directing opening and/or closure of the front and/or rear ports.

DETAILED DESCRIPTION OF THE PREFERRED EMBODIMENT

Figure 1:
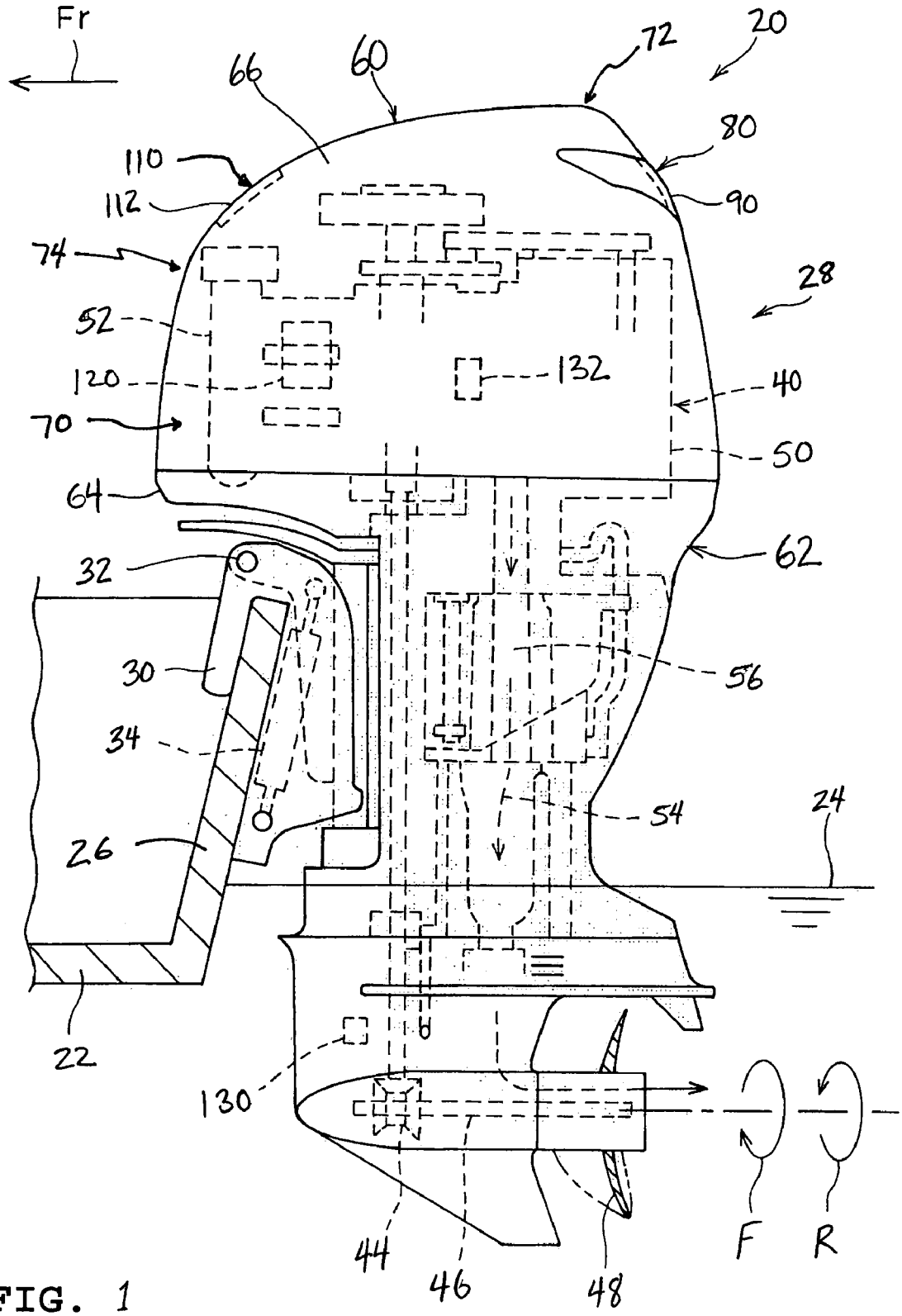
FIG. 1 is a side view showing an embodiment of an outboard motor mounted on a boat hull, and showing certain internal components of the motor in phantom.
Figure 2:
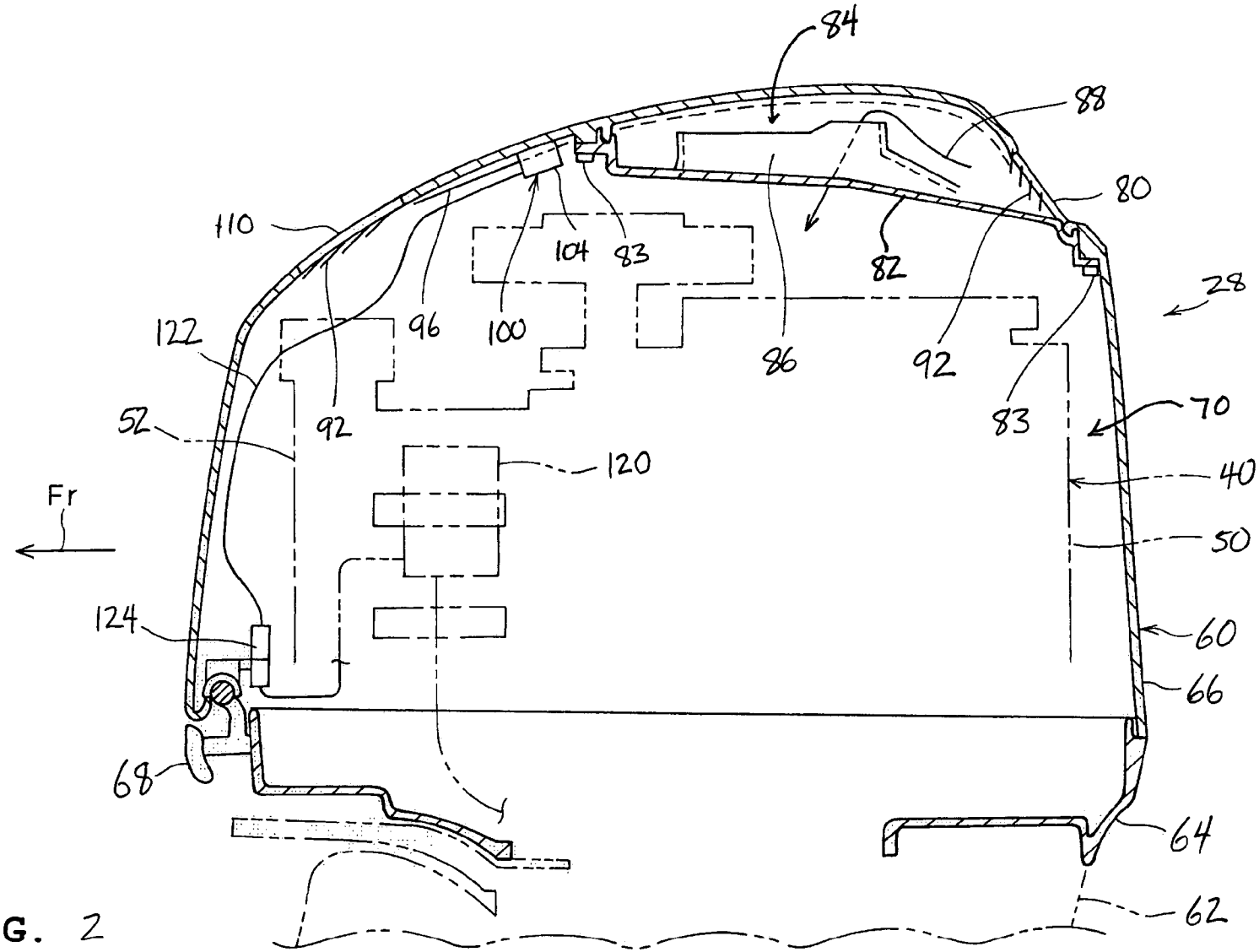
FIG. 2 is a sectional view of a cowling portion of the outboard motor of FIG. 1.

With reference to FIGS. 1 and 2, in accordance with a first embodiment, a small boat 20 is shown. The boat 20 includes a hull 22 that is configured to float in a body of water 24. A stern 26 of the hull is adapted to be connected to an outboard motor 28 so that the outboard motor 28 is supported on the stern 26. A clamp 30 of the outboard motor 28 attaches to the stern 26. Preferably, the clamp includes a pivot 32, and a hydraulic actuator 34 facilitates the outboard motor rotating about the pivot 32 when mounted upon the stern 26. The arrow Fr indicates the direction of forward travel of the boat.

The outboard motor 28 includes an internal combustion engine 40 that is adapted to rotatably drive a driveshaft 42. The driveshaft 42 engages a transmission 44, which preferably is adapted to be switchable between a forward drive state F, a reverse drive state R, and a neutral drive state N.

In a preferred embodiment, a remote switching apparatus in the boat 20 controls switching of the transmission 44. The transmission transmits rotation from the driveshaft 42 to an output shaft 46 upon which a propeller 48 is mounted. As such, when the transmission is in the forward drive state F, the propeller spins so as to propel the boat in a forward direction, and when the transmission 44 is in a reverse drive state R, the propeller 48 spins so as to propel the boat in a reverse direction. In the neutral state N, rotation is not communicated from the driveshaft 42 to the propeller 48.

The internal combustion engine 40 preferably comprises an engine body 50 and an air intake manifold 52. Air is drawn into the intake manifold 52, combined with fuel and combusted in the engine body 50, and transmitted as exhaust 54 to an exhaust passage 56. The exhaust passage 56 preferably communicates the exhaust 54 to an exhaust outlet below the water line 24.

With specific reference to FIG. 1, the outboard motor 28 preferably comprises a cowling 60 and a casing 62 which cooperate to enclose components of the motor 28. With reference also to FIG. 2, a cowling base 64 is adapted to receive a cowling body 66. The cowling body 66 is attached to the cowling base 64 via a coupler 68. The cowling 60 generally has a rear portion 72 and an opposed front portion 74. An engine compartment 70 is defined as the space enclosed between the cowling body 66 and the engine 40.

Figure 3:
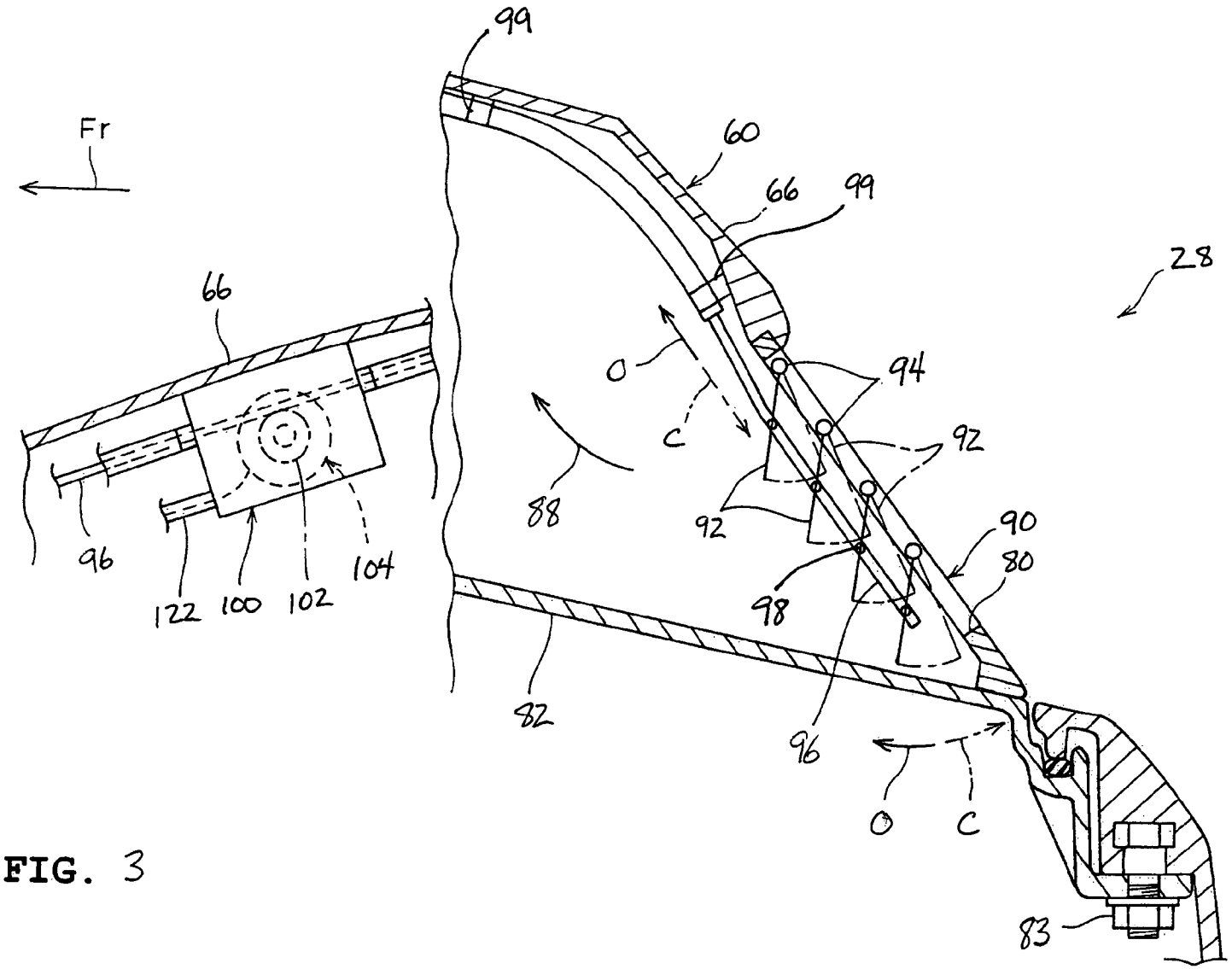
FIG. 3 is a partial enlarged cutaway view of FIG. 2 showing an embodiment of the invention.

With reference also to FIG. 3, preferably a rear air inlet port 80 is formed through the rear portion 72 of the cowling body 66. In the illustrated embodiment, an air intake device wall 82 is attached to an inner portion of the cowling body 66 by a plurality of fasteners 83. The air intake device wall 82 cooperates with the cowling body 66 to define an intake space 84 therebetween. Preferably a duct 86 is formed through the wall 82. As such, air 88 enters the rear inlet port 80, and preferably follows a tortuous path through the intake space 84 and through the duct 86 before entering the engine compartment. At least some water that may be entrained in the air 88 is removed from the air 88 as it follows the tortuous path. Additionally, preferably there is no direct path through the rear inlet port and into the engine compartment 70. As such, water splashes are denied direct access to the engine compartment 70. Water is thus prevented or limited from accessing the engine compartment 70 so that water drawn with the air into the intake manifold 52 and into the engine 40 is minimized. Minimal water content in the intake air improves engine performance.

With specific reference to FIGS. 2 and 3, the rear port 80 preferably comprises a rear closure device 90 that is configured to selectively open O and close C the port 80. In the illustrated embodiment, the closure device 90 comprises a plurality of flaps 92 that are each attached to edges of the rear port 80 at opposing pivot mounts 94. As such, each flap 92 can pivot about the pivot mounts 94. Each of the flaps 92 preferably is elongate and generally shaped as a flat plate.

In the illustrated embodiment, the flaps 92 are arranged side-by-side and are adapted to pivot about an axis generally transverse to a longitudinal axis of the outboard motor 28. When the plurality of flaps 92 pivot about the corresponding pivot mounts 94, they can swing inwardly to an open position O or to a closed position C in which portions of the adjacent flaps overlap one another in order to close the port 80.

In another embodiment, the flaps may be adapted to swing outwardly to establish an open position, and swing generally inwardly to engage each other in a closed position. In the illustrated embodiment, a control cable 96 attaches to each of the flaps 92 at flap connectors 98. The control cable 96 preferably is sufficiently sturdy to push the flaps 92 to the closed position C and pull the flaps 92 to the open position O.

With continued reference to FIGS. 2 and 3, preferably the control cable 96 is controlled by an actuator 100. In the illustrated embodiment, the actuator 100 is attached to an inner surface of the cowling body 66 and comprises a gear 102 that is adapted to engage the cable 96. The gear 102 is rotated by an electric driver 104 so as to advance and retract the cable as desired, thus opening and closing the rear closure device 90. When the rear closure device 90 is open, air 88 can flow through the rear port 80 to the intake space 84 and then to the engine compartment 70. Conversely, when the closure device 90 is in the closed position C, air is blocked from flowing through the port 80. As shown particularly in FIG. 3, the cable 96 preferably extends along the underside of the cowling body 66 and is attached to the cowling body by connectors 99.

With continued reference to FIGS. 2 and 3, in accordance with another embodiment, a front air inlet port 110 is provided in the front portion 74 of the cowling body 66. In the illustrated embodiment, the front port 110 comprises a front closure device 112 that also is made up of a plurality of flaps 92 that are pivotably mounted 94 and controlled by a control cable 96 that attaches to the flaps at flap connectors 98.

In the illustrated embodiment, the same actuator 100 and control cable 96 are used to control both the front and rear closure devices 112, 90. Preferably, as the rear closure device 90 moves toward the open position O, the front closure device 112 moves toward the closed position C, and vice versa, since the same control cable 96 and actuator 100 control the flaps. In another embodiment, the front and rear closure devices 90, 112 are separately controllable to open and close independent of one another. This can be accomplished by using multiple actuators, or an actuator having a different set-up that allows such independent movement.

In the illustrated embodiment, the front port 110 is shown opening directly into the engine compartment 70. It is to be understood that, in other embodiments, an intake space can also be defined about the front port 110. Preferably, a water repellent filter is disposed in an air pathway between the front port 110 and the engine compartment 70. The water repellent filter is adapted to prevent or minimize passage of water.

With specific reference again to FIGS. 1 and 2, a control unit 120, such as a central processing unit (CPU) preferably is provided within the cowling 60. Preferably, the control unit 120 accepts certain sensor readings and directs certain engine processes in accordance with preset routines and programs. In the illustrated embodiment, the control unit 120 directs operation of the actuator 100. As shown in FIGS. 1–3, the control unit communicates with the actuator 100 via an electrical wire 122 that extends therebetween. An electrical coupling 124 enables selective detachment of the electrical wire 122 such as, for example, when the cowling body 66 is removed from the cowling base 64.

In the illustrated embodiment, a drive position sensor 130 detects the state of the transmission 44. Specifically, the drive position sensor 130 detects whether the transmission is in the forward drive state F, reverse drive state R, or neutral state N. This information is communicated to the control unit 120. In accordance with one embodiment, when the drive position sensor 130 detects that the transmission is moved into the forward drive state F, the control unit 120 signals the actuator 100 to open the rear closure device 90 and close the front closure device 112 so that air 88 may flow only through the rear air inlet port 80. When the boat 20 is moving forwardly, it is anticipated that water splashes and the like will be concentrated mostly upon the front portion 74 of the outboard motor. Thus, air drawn through the rear port 80 will have the minimum water content, and closure of the front port 110 prevents water intrusion therethrough.

In accordance with another embodiment, when the drive position sensor 130 detects that the transmission has been placed in a reverse drive state R, the control unit 120 directs the actuator 100 to close the rear closure device 90 and open the front closure device 112 so that air is taken through only the front inlet port 110. As such, when the boat 20 is moving in a reverse direction, such that water splashes and the like are more likely concentrated on the rear portion 72 of the outboard motor 28, air is drawn through the front inlet 110 so as to draw in air that is less likely to have a high water content.

In accordance with another embodiment, an engine rotational speed sensor 132 detects the rotational speed of the engine 40 and communicates such data to the control unit 120. In accordance with still another embodiment, when the boat 20 is moving forwardly and the engine speed sensor 132 detects an engine speed above a threshold level, the control unit 120 directs the actuator 100 to at least partially open the front intake port 110. In some embodiments, the rear intake port 80 will correspondingly be partially closed. However, in other embodiments the rear intake port 80 will remain fully open as the front port is also opened. As a boat moves forwardly at relatively high speeds, a negative air pressure may develop in the rear portion 72 of the outboard motor 28. As such, it may be difficult or impossible to draw enough air through the rear port 80 to satisfy the engine's 40 air intake needs in order to maximize engine performance. At least partially opening the front intake port 110 increases the amount of air available, and thus enables increased engine performance.

In accordance with a still further embodiment, as the detected engine speed increases above the threshold level, the front inlet port 110 is incrementally opened more and more. It is to be understood that the threshold engine speed is determined as a speed at which it is anticipated that negative air pressure will have built up at the rear portion 72 of the outboard motor 28 to a degree that the benefit of obtaining additional air from the front intake port 110 is worth the risk of decreased engine performance due to increased entry of water into the engine compartment 70 through the front intake port 110.

In accordance with a still further embodiment, when a boat is moving forwardly, but then begins decelerating, it is not uncommon for water spray and wave action to be directed towards the rear portion 72 of the outboard motor 28. Accordingly, in another embodiment, when the engine speed sensor 132 detects a decrease in engine speed, thus indicating boat deceleration, the control unit 120 directs the actuator 100 to at least partially the close the rear inlet port 80 and open the front inlet port 110. In accordance with a still further embodiment, such action is only directed if the engine speed sensor 132 detects engine speed decreasing at a relatively fast rate, thus indicating sharp deceleration rather than simply mild reduction in the boat's forward speed. Additionally, in another embodiment, the rear port 80 is fully closed and the front port 110 is fully opened upon detection of such sharp deceleration. Preferably, the control unit 120 is programmed so as to detect sharp deceleration, compare the detailed rate of deceleration with a threshold value that has been stored in the control unit 120, and determine whether the rate of deceleration exceeds the threshold value. It is to be understood, however, that in other embodiments, additional factors may be considered by the control unit 120. For example, if the engine speed is decelerating, but not at a deceleration rate greater than the threshold value, but if the engine speed is sufficiently low to indicate that the boat is moving relatively slowly, the control unit may be adapted to direct at least partial closure of the rear port 80 and opening of the front port 110.

In a still further embodiment, the control unit 120 is adapted to direct at least partial opening of the front port 110 when the boat is being operated at a low engine speed, whether or not engaged in the forward, neutral, or reverse drive states. Additionally, in other embodiments, if one of the front or rear closure members 112, 90 is malfunctioning, blocked, or the like, the other of the closure members may be opened regardless of the engine drive state, speed, or the like. Preferably, the control unit 120 is adapted to detect whether either a closure member 90, 112 is responding as directed. As such, the control unit 120 can detect such malfunctions and direct appropriate inlet opening.

Figure 4:
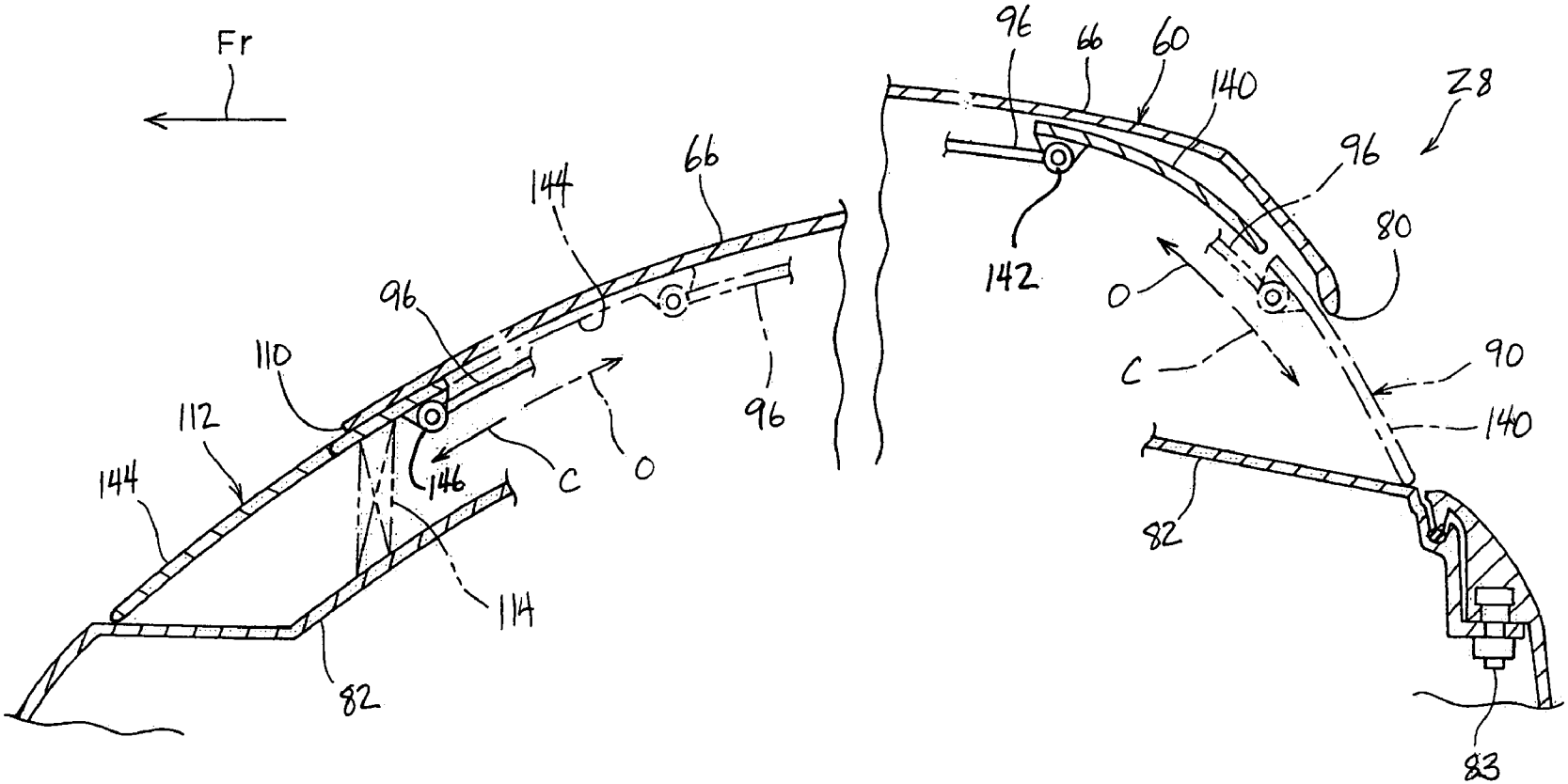
FIG. 4 is another partial enlarged cutaway view of a cowling as in FIG. 2, showing another embodiment.

With reference next to FIG. 4, another embodiment is illustrated in which the rear closure device 90 comprises a rear sliding member 140 that is adapted to selectively slide into place to block the rear port 80 while in a closed position C or slide out of the way of the rear inlet port 80 while in the open position O. Preferably, the sliding member 140 is connected via a connector 142 to a control cable 96, which is controlled by an actuator in accordance with any manner, such as the manner discussed in the above embodiments. Similarly, a front sliding member 144 is attached to a control cable 96 at a connector 146 and is adapted to slide across and substantially close the front air inlet port 110 when in a closed position C and slide out of the way of the port 110 when in an open position O. Preferably, the slide members 140, 144 are provided with tracks (not shown) attached or formed in the cowling body 66 in order to guide the sliding members into place. Additionally, the sliding members preferably are substantially flexible in order to better facilitate engagement with the port edges and closure of the respective ports 80, 110.

It is to be understood that any structure and apparatus for selectively closing the front and rear inlet ports 80, 110, can advantageously be used. For example, in another embodiment, each of the front and rear ports 110, 80 comprises one or a plurality of shutters adapted to swing into or out of place to open and close the corresponding port. Additionally, in other embodiments, the closure apparatus, be it flaps, a plate, sliding member, or the like, is substantially 3-dimensional so as to maintain the curvature of the outer surface of the cowling body 66. In still further embodiments, the port closure system may be arranged on an outer surface of the cowling body 66.

With continued reference to FIG. 4, an embodiment is shown wherein an intake device wall 82 is common between the front and rear inlet ports 80, 110, so that air that enters the front or rear ports 80, 100 enters the same intake space before proceeding through one or more ducts and into the engine compartment 70. It is to be understood, however, that in additional embodiments, separate front and rear intake spaces may be defined. The front and rear intake spaces may be completely independent of one another, or may, in additional embodiments, include passages to communicate with one another.

With continued reference to FIG. 4, a water repellent filter 114 is provided in an air path between the front port 110 and the engine compartment 70. In the illustrated embodiment, no such water repellent filter is provided in an air path between the rear port 80 and the engine compartment 70. As is known in the art, water repellent filters, though generally effective at preventing flow of water through the filter, may often result in relatively large air pressure drops from one side of the filter to another. As such, water filters may cause significant resistance to air flow. When an engine has high air intake requirements, such as at high speed, such air flow resistance can significantly impair intake air availability and lead to poor engine performance. As such, it is often not desired to use such filters. However, in instances in which engine intake requirements are relatively low, and especially if a risk of water intake is relatively high, a water repellent filter may be advantageous.

In one or more embodiments discussed herein, no water repellent filter is used through the rear of the port so that, when the engine is operating at relatively high forward speeds, air 88 flows easily through the port 80 and to the engine. However, when engine speeds are relatively low, such as upon sharp deceleration or when a boat is being operated in reverse, the engine speed is typically relatively low, engine intake air requirements are correspondingly low, and employment of a water repellent filter will not substantially impair engine performance.

In accordance with another embodiment, the control unit 120, as it monitors various engine conditions, is adapted to identify when the engine needs more air to improve performance, but is not receiving such additional air. When this situation is detected, the control unit 120 is adapted to direct at least partial opening of the front port 110. In a still further embodiment, an air flow sensor may be provided in connection with the intake manifold or other appropriate areas of the engine air intake system. The control unit 120 evaluates sensed air intake data in light of engine performance data to determine whether there is a need for additional air supply. If such a need is identified, the controller 120 will direct at least partial opening of the front inlet port 110.

In the illustrated embodiments, the front and rear closure members are operated by an actuator 100 and control cable 96. It is to be understood that other types of closure devices and actuating devices may be used. For example, an actuator including a linkage may be employed. Additionally, independent actuators for each of the front and rear inlet ports 110, 80 may be employed. Further, one or more actuators may be controlled by a hard-wired electrical wire, or may include wireless radio-controlled devices adapted to receive control signals supplied by a corresponding wireless transmitter associated with the control unit 120. Still further, an actuator may be manually controlled by an operator by a remote control location, such as on the boat, or directly at the outboard motor. In still further embodiments, the front and rear inlet ports may be manually closed and opened by an operator as desired.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. For example, specific structural aspects and operational procedures of certain embodiments can be used in connection with aspects of other embodiments as appropriate. Thus, it is intended that the scope of the present invention herein disclosed should not be limited by the particular disclosed embodiments described above, but should be determined only by a fair reading of the claims that follow.

What is claimed is:

1. An outboard motor, comprising an internal combustion engine and a cowling, the cowling generally enclosing at least an upper portion of the engine and defining an engine compartment, the cowling having front and rear portions, a rear air inlet port being formed through the rear portion of the cowling, the rear inlet port having a rear closure device adapted to selectively move between an open position and a closed position, wherein the rear closure device is adapted so that when the closure device is in the open position air from outside the cowling can be selectively drawn through the rear inlet port, and when the closure device is in the closed position air does not substantially pass through the rear inlet port, wherein the rear closure device comprises a plurality of flaps, each flap being pivotablv mounted to edges of the port and the flaps are arranged generally adjacent one another and adapted to pivot so as to generally engage one another to close the inlet when in the closed position.

2. The outboard motor of claim 1 additionally comprising a front air inlet port formed through the front portion of the cowling, the front inlet port having a front closure device adapted to selectively move between an open position and a closed position, wherein the front closure device is adapted so that when the closure device is in the open position air from outside the cowling can be selectively drawn through the front inlet port, and when the closure device is in the closed position air does not substantially pass through the front inlet port.

3. The outboard motor of claim 2, wherein a water repellent filter is interposed between the front air inlet port and the engine compartment.

4. An outboard motor, comprising an internal combustion engine and a cowling, the cowling generally enclosing at least an upper portion of the engine and defining an engine compartment, the cowling having front and rear portions, a rear air inlet port being formed through the rear portion of the cowling, the rear inlet port having a rear closure device adapted to selectively move between an open position and a closed position, wherein the rear closure device is adapted so that when the closure device is in the open position air from outside the cowling can be selectively drawn through the rear inlet port, and when the closure device is in the closed position air does not substantially pass through the rear inlet port, wherein the rear closure device comprises a sliding member configured and mounted so as to slide across the rear inlet to substantially close the inlet when in the closed position.

5. The outboard motor of claim 4 additionally comprising a front air inlet port formed through the front portion of the cowling, the front inlet port having a front closure device adapted to selectively move between an open position and a closed position, wherein the front closure device is adapted so that when the closure device is in the open position air from outside the cowling can be selectively drawn through the front inlet port, and when the closure device is in the closed position air does not substantially pass through the front inlet port.

6. An outboard motor, comprising an internal combustion engine and a cowling, the cowling generally enclosing at least an upper portion of the engine and defining an engine compartment, the cowling having front and rear portions, a rear air inlet port being formed through the rear portion of the cowling and having a rear closure device, a front air inlet port being formed through the front portion of the cowling and having a front closure device, each of the front and rear closure devices adapted to selectively move between an oven position and a closed position so that when the closure device is in the open position air from outside the cowling can be selectively drawn through the associated inlet port, and when the closure device is in the closed position air does not substantially pass though the associated inlet port, and at least one actuator is provided, the at least one actuator adapted to move the rear closure device between the open and closed positions and to move the front closure device between the open and closed positions.

7. The outboard motor of claim 6, wherein the at least one actuator simultaneously moves one of the front and rear closure devices to the closed position while the other of the front and rear closure devices is moved to the open position.

8. The outboard motor of claim 6 additionally comprising a transmission having forward, neutral and reverse drive states, and a controller adapted to control operation of the actuator, wherein the controller is adapted to close the rear air inlet port and open the front inlet port when the transmission changes to the reverse drive state.

9. The outboard motor of claim 8, wherein the controller is adapted to close the front air inlet port and open the rear inlet port when the transmission changes to the forward drive state.

10. The outboard motor of claim 8 additionally comprising an engine speed sensor, and wherein the controller is adapted to open the front air inlet port when the transmission is in the forward drive state and the engine speed sensor indicates that engine speed is above a threshold level.

11. The outboard motor of claim 10, wherein the controller is adapted to open the front air inlet port incrementally as sensed engine speed increases above the threshold level.

12. The outboard motor of claim 8 additionally comprising an engine speed sensor, and wherein the controller is adapted to open the front air inlet port when the transmission is in the forward drive state and the engine speed sensor indicates that engine speed is decreasing.

13. The outboard motor of claim 12, wherein the controller is adapted to open the front air inlet port when engine speed is decreasing only if engine speed is decreasing at a rate that exceeds a threshold rate.

14. The outboard motor of claim 6, wherein a single actuator directs movement of both the front and rear closure devices.

15. The outboard motor of claim 6, wherein a plurality of actuators direct movement of the front and rear closure devices.

16. The outboard motor of claim 6 additionally comprising a controller adapted to control operation of the at least one actuator, wherein the controller directs full or partial closure of the rear and front inlet ports depending on sensed conditions.

17. The outboard motor of claim 16, wherein the controller directs operation of the at least one actuator based at least in part upon engine air intake needs.

18. The outboard motor of claim 16 additionally comprising a transmission having forward, neutral and reverse drive states, and wherein the controller directs operation of the at least one actuator based at least in part upon the transmission drive state.

19. The outboard motor of claim 16, wherein the controller directs operation of the at least one actuator based at least in part upon engine speed.

20. The outboard motor of claim 19, wherein a water repellent filter is interposed between only one of the front and rear air inlet ports and the engine compartment, and the controller is adapted to direct opening of the front and rear inlet ports so that the inlet port not associated with the filter is open at relatively high engine speed, but closed at relatively low engine speed.

21. The outboard motor of claim 20, wherein the water repellent filter is interposed between the front air inlet port and the engine compartment.

22. An outboard motor, comprising an internal combustion engine and a cowling, the cowling generally enclosing at least an upper portion of the engine and defining an engine compartment, the cowling having front and rear portions, a rear air inlet port being formed through the rear portion of the cowling and having a rear closure device, a front air inlet port being formed through the front portion of the cowling and having a front closure device, each of the front and rear closure devices adapted to selectively move between an open position and a closed position so that when the closure device is in the open position air from outside the cowling can be selectively drawn through the associated inlet port, and when the closure device is in the closed position air does not substantially pass through the associated inlet port, and a water repellent filter is interposed between the front air inlet port and the engine compartment.

23. The outboard motor of claim 22, wherein the cowling additionally comprises an intake space between the rear air inlet port and the engine compartment, and the front and rear air inlet ports both open into the intake space.

* * * * *